US008768713B2

(12) United States Patent
Chaoui et al.

(10) Patent No.: US 8,768,713 B2
(45) Date of Patent: Jul. 1, 2014

(54) SET-TOP-BOX WITH INTEGRATED ENCODER/DECODER FOR AUDIENCE MEASUREMENT

(75) Inventors: Luc Chaoui, Columbia, MD (US); Taymoor Arshi, Potomac, MD (US); John Stavrapolous, Edison, NJ (US); Todd Cowling, Severn, MD (US); Taher Behbehani, Miami Beach, FL (US)

(73) Assignee: The Nielsen Company (US), LLC, Schaumburg, IL (US)

( * ) Notice: Subject to any disclaimer, the term of this patent is extended or adjusted under 35 U.S.C. 154(b) by 71 days.

(21) Appl. No.: 12/724,070

(22) Filed: Mar. 15, 2010

(65) Prior Publication Data

US 2011/0224992 A1 Sep. 15, 2011

(51) Int. Cl.

| | |
|---|---|
| ***G10L 19/00*** | (2013.01) |
| ***G10L 21/04*** | (2013.01) |
| ***G10L 11/00*** | (2006.01) |
| ***G10L 19/12*** | (2013.01) |

(52) U.S. Cl.

USPC ..... 704/500; 704/200; 704/200.1; 704/220; 704/212; 704/223; 704/501; 704/502; 704/503; 704/504

(58) Field of Classification Search

USPC ..... 704/500, 501, 502, 200, 212, 220, 704/200.1, 223, 503, 504; 725/14; 700/94

See application file for complete search history.

(56) References Cited

U.S. PATENT DOCUMENTS

| | | | | |
|---|---|---|---|---|
| 4,230,990 A | | 10/1980 | Lert, Jr. et al. | |
| 5,019,899 A | | 5/1991 | Boles et al. | |
| 5,379,345 A | * | 1/1995 | Greenberg | 455/2.01 |
| 5,425,100 A | | 6/1995 | Thomas et al. | |
| 5,450,490 A | * | 9/1995 | Jensen et al. | 380/253 |
| 5,481,294 A | | 1/1996 | Thomas et al. | |
| 5,512,933 A | | 4/1996 | Wheatley et al. | |
| 5,543,856 A | | 8/1996 | Rosser et al. | |
| 5,553,193 A | * | 9/1996 | Akagiri | 704/200.1 |
| 5,574,962 A | * | 11/1996 | Fardeau et al. | 455/2.01 |

(Continued)

FOREIGN PATENT DOCUMENTS

| | | |
|---|---|---|
| WO | 03/094499 | 11/2003 |
| WO | 2005025217 | 3/2005 |

OTHER PUBLICATIONS

Critical Band Encoding Technology Audio Encoding System from Arbitron, Technical Overview, Document 1050-1054, Revision E, Feb. 2008.*

(Continued)

*Primary Examiner* — Edgar Guerra-Erazo

(74) *Attorney, Agent, or Firm* — Hanley, Flight & Zimmerman, LLC

(57) ABSTRACT

Systems and methods are disclosed for encoding audio in a set-top box that is invoked by a user when listening to a broadcast audio signal from a radio, TV, streaming or other audio device. A detection and identification system comprising an audio encoder is integrated in a set-top box, where detection and identification of media is realized. The encoding automatically identifies characteristics of the media (e.g., the source of a particular piece of material) by embedding an inaudible code within the content. This code contains information about the content that can be decoded by a machine, but is not detectable by human hearing. The embedded code may be used to provide programming information to the view or audience measurement date to the provider.

20 Claims, 11 Drawing Sheets

(56) References Cited

U.S. PATENT DOCUMENTS

| | | | | | |
|---|---|---|---|---|---|
| 5,579,124 | A * | 11/1996 | Aijala et al. | 386/201 |
| 5,581,800 | A * | 12/1996 | Fardeau et al. | 455/2.01 |
| 5,629,739 | A | 5/1997 | Dougherty | |
| 5,764,763 | A * | 6/1998 | Jensen et al. | 380/253 |
| 5,815,671 | A | 9/1998 | Morrison | |
| 5,835,030 | A * | 11/1998 | Tsutsui et al. | 341/51 |
| 5,850,249 | A * | 12/1998 | Massetti et al. | 725/14 |
| 5,872,588 | A | 2/1999 | Aras et al. | |
| 5,907,366 | A | 5/1999 | Farmer et al. | |
| 5,966,120 | A | 10/1999 | Arazi et al. | |
| 6,029,045 | A | 2/2000 | Picco et al. | |
| 6,286,140 | B1 * | 9/2001 | Ivanyi | 725/14 |
| 6,308,327 | B1 | 10/2001 | Liu et al. | |
| 6,311,161 | B1 * | 10/2001 | Anderson et al. | 704/500 |
| 6,675,383 | B1 | 1/2004 | Wheeler et al. | |
| 6,735,775 | B1 | 5/2004 | Massetti | |
| 6,845,360 | B2 * | 1/2005 | Jensen et al. | 704/500 |
| 6,850,619 | B1 * | 2/2005 | Hirai | 380/203 |
| 6,871,180 | B1 * | 3/2005 | Neuhauser et al. | 704/500 |
| 7,006,555 | B1 | 2/2006 | Srinivasan | |
| 7,039,932 | B2 | 5/2006 | Eldering | |
| 7,239,981 | B2 | 7/2007 | Kolessar et al. | |
| 7,440,674 | B2 | 10/2008 | Plotnick et al. | |
| 7,908,133 | B2 * | 3/2011 | Neuhauser | 704/203 |
| 7,961,881 | B2 * | 6/2011 | Jensen et al. | 380/252 |
| 7,962,934 | B1 * | 6/2011 | Eldering et al. | 725/36 |
| RE42,627 | E * | 8/2011 | Neuhauser et al. | 704/500 |
| 2001/0056573 | A1 | 12/2001 | Kovac et al. | |
| 2002/0124246 | A1 | 9/2002 | Kaminsky et al. | |
| 2002/0144262 | A1 | 10/2002 | Plotnick et al. | |
| 2002/0194592 | A1 | 12/2002 | Tsuchida et al. | |
| 2003/0039465 | A1 | 2/2003 | Bjorgan et al. | |
| 2003/0081781 | A1 * | 5/2003 | Jensen et al. | 380/253 |
| 2004/0073916 | A1 | 4/2004 | Petrovic et al. | |
| 2004/0102961 | A1 * | 5/2004 | Jensen et al. | 704/201 |
| 2004/0137929 | A1 * | 7/2004 | Jones et al. | 455/517 |
| 2005/0028189 | A1 | 2/2005 | Heine et al. | |
| 2005/0033758 | A1 | 2/2005 | Baxter | |
| 2005/0125820 | A1 | 6/2005 | Nelson et al. | |
| 2005/0216509 | A1 * | 9/2005 | Kolessar et al. | 707/104.1 |
| 2006/0110005 | A1 | 5/2006 | Tapson | |
| 2006/0222179 | A1 * | 10/2006 | Jensen et al. | 380/252 |
| 2007/0006275 | A1 | 1/2007 | Wright et al. | |
| 2007/0100483 | A1 * | 5/2007 | Kentish et al. | 700/94 |
| 2007/0124757 | A1 | 5/2007 | Breen | |
| 2007/0162927 | A1 | 7/2007 | Ramaswamy et al. | |
| 2008/0002854 | A1 | 1/2008 | Tehranchi et al. | |
| 2008/0056675 | A1 | 3/2008 | Wright et al. | |
| 2008/0086304 | A1 | 4/2008 | Neuhauser | |
| 2009/0037575 | A1 * | 2/2009 | Crystal et al. | 709/224 |
| 2009/0222848 | A1 * | 9/2009 | Ramaswamy | 725/9 |
| 2010/0037251 | A1 | 2/2010 | Lindhult | |
| 2010/0131970 | A1 | 5/2010 | Falcon | |
| 2010/0226494 | A1 * | 9/2010 | Lynch et al. | 380/28 |
| 2010/0268540 | A1 | 10/2010 | Arshi et al. | |
| 2010/0268573 | A1 | 10/2010 | Jain et al. | |
| 2011/0106587 | A1 * | 5/2011 | Lynch et al. | 705/7.33 |
| 2011/0246202 | A1 | 10/2011 | McMillan et al. | |
| 2012/0022879 | A1 * | 1/2012 | Srinivasan | 704/500 |

OTHER PUBLICATIONS

Intark Han; Hong-Shik Park; Youn-Kwae Jeong; Kwang-Roh Park; , "An integrated home server for communication, broadcast reception, and home automation," Consumer Electronics, IEEE Transactions on , vol. 52, No. 1, pp. 104-109, Feb. 2006.*

Canadian Intellectual Property Office, Notice of Allowance, issued in connection with CA Application No. 2,574,998, dated Aug. 10, 2010, 1 page.

Canadian Intellectual Property Office, Official Action issued in connection with CA Application No. 2,574,998, mailed Nov. 13, 2009, 10 pages.

Canadian Intellectual Property Office, Official Action issued in connection with CA Application No. 2,574,998, mailed Aug. 26, 2008, 4 pages.

Canadian Intellectual Property Office, Official Action issued in connection with CA Application No. 2,574,998, mailed Mar. 23, 2009, 5 pages.

USPTO, "Office Action," issued in connection with U.S. Appl. No. 11/618,245, dated Jul. 3, 2013, 24 pages.

USPTO, "Office Action," issued in connection with U.S. Appl. No. 11/618,245, dated Jul. 21, 2009, 26 pages.

USPTO, "Advisory Action," issued in connection with U.S. Appl. No. 11/618,245, dated Sep. 30, 2009, 3 pages.

USPTO, "Office Action," issued in connection with U.S. Appl. No. 11/618,245, dated Oct. 26, 2011, 33 pages.

USPTO, "Office Action," issued in connection with U.S. Appl. No. 11/618,245, dated Apr. 28, 2011, 37 pages.

USPTO, "Office Action," issued in connection with U.S. Appl. No. 11/618,245, dated Feb. 5, 2009, 35 pages.

International Preliminary Report on Patentability, issued in PCT Application No. PCT/US2005/026426, mailed Feb. 1, 2007, 9 pages.

Patent Cooperation Treaty, "International Search Report and the Written Opinion of the International Searching Authority," issued in PCT Application No. PCT/US11/28440, mailed May 12, 2011, 8 pages.

Patent Cooperation Treaty, "International Search Report and the Written Opinion of the International Searching Authority," issued in PCT Application No. PCT/US05/26426, mailed Aug. 18, 2006, 10 pages.

Sun, Yuanyuan, "Forensic Audio Watermarking for Digital Video Broadcasting," Eindhoven University of Technology, Department of Mathematics and Computer Science, Aug. 2009, 57 pages.

Whittemore, Rick, "Watermarking Video in STBs for forensic tracking with Dolby's Cinea Running Marks," Cinea Inc. (Division of Dolby Laboratories), Sep. 19, 2008, 5 pages.

USPTO, "Office Action," issued in connection with U.S. Appl. No. 11/618,245, dated Dec. 31, 2013 (27 pages).

* cited by examiner

SET-TOP-BOX WITH INTEGRATED ENCODER/DECODER FOR AUDIENCE MEASUREMENT

TECHNICAL FIELD

The present disclosure relates to encoding and decoding broadcast or recorded segments such as broadcasts transmitted over the air, via cable, satellite or otherwise, and video, music or other works distributed on previously recorded media, and more specifically, processing media data within a set-top box (STB) that includes encoding/decoding, for subsequent use in media and/or market research.

BACKGROUND INFORMATION

There is considerable interest in monitoring and measuring the usage of media data accessed by an audience via a network or other source. In order to determine audience interest and what audiences are being presented with, a user's system may be monitored for discrete time periods while connected to a network, such as the Internet.

There is also considerable interest in providing market information to advertisers, media distributors and the like which reveal the demographic characteristics of such audiences, along with information concerning the size of the audience. Further, advertisers and media distributors would like the ability to produce custom reports tailored to reveal market information within specific parameters, such as type of media, user demographics, purchasing habits and so on. In addition, there is substantial interest in the ability to monitor media audiences on a continuous, real-time basis. This becomes very important for measuring streaming media data accurately, because a snapshot or event generation fails to capture the ongoing and continuous nature of streaming media data usage.

Based upon the receipt and identification of media data, the rating or popularity of various web sites, channels and specific media data may be estimated. It would be advantageous to determine the popularity of various web sites, channels and specific media data according to the demographics of their audiences in a way which enables precise matching of data representing media data usage with user demographic data.

As disclosed in U.S. Pat. No. 7,460,827 to Schuster, et al. and U.S. Pat. No. 7,222,071 to Neuhauser, et al., which are hereby incorporated by reference in their entirety herein, specialized technology exists where a small, pager-size, specially-designed receiving stations called Portable People Meters (PPM) allow for the tracking of media exposure for users/panelists. In these applications, the embedded audio signal or ID code is picked up by one or more PPMs, which capture the encoded identifying signal, and store the information along with a time stamp in memory for retrieval at a later time. A microphone contained within the PPM receives the audio signal, which contains within it the ID code.

One of the goals of audience measurement is to identify the audience for specific channel viewing. With the HDTV and Digital age upon us, nearly every household has a STB attached to their TV, this allows for access to viewing habits and other household penetration. Therefore it would be advantageous to integrate audio encoding technology with one or more STBs for monitoring purposes. Furthermore, due to the STB's advanced design, performance and scalability, the STB does not only supply high real-time performance affordably, but can also be easily remotely reprogrammed for new configurations, updates, upgrades and applications. The integration of audio encoding technology with STB devices would eliminate unnecessary equipment and reduce associated costs.

SUMMARY

Under an exemplary embodiment, a detection and identification system is integrated with a Set-top box (STB), where a system for audio encoding is implemented within a STB. The encoding automatically identifies, at a minimum, the source of a particular piece of material by embedding an inaudible code within the content. This code contains information about the content that can be decoded by a machine, but is not detectable by human hearing.

An STB, for the purposes of this disclosure, may be simply defined as a computerized device that processes digital information. The STB may come in many forms and can have a variety of functions. Digital Media Adapters, Digital Media Receivers, Windows Media Extender and most video game consoles are also examples of set-top boxes. Currently the type of TV set-top box most widely used is one which receives encoded/compressed digital signals from the signal source (e.g., the content provider's headend) and decodes/decompresses those signals, converting them into analog signals that an analog (SDTV) television can understand. The STB accepts commands from the user (often via the use of remote devices such as a remote control) and transmits these commands back to the network operator through some sort of return path. The STB preferably has a return path capability for two-way communication.

STBs can make it possible to receive and display TV signals, connect to networks, play games via a game console, surf the Internet, interact with Interactive Program Guides (IPGs), virtual channels, electronic storefronts, walled gardens, send e-mail, and videoconference. Many STBs are able to communicate in real time with devices such as camcorders, DVD and CD players, portable media devices and music keyboards. Some have large dedicated hard-drives and smart card slots to insert smart cards into for purchases and identification.

For this application the following terms and definitions shall apply:

The term "data" as used herein means any indicia, signals, marks, symbols, domains, symbol sets, representations, and any other physical form or forms representing information, whether permanent or temporary, whether visible, audible, acoustic, electric, magnetic, electromagnetic or otherwise manifested. The term "data" as used to represent predetermined information in one physical form shall be deemed to encompass any and all representations of corresponding information in a different physical form or forms.

The terms "media data" and "media" as used herein mean data which is widely accessible, whether over-the-air, or via cable, satellite, network, internetwork (including the Internet), print, displayed, distributed on storage media, or by any other means or technique that is humanly perceptible, without regard to the form or content of such data, and including but not limited to audio, video, audio/video, text, images, animations, databases, broadcasts, displays (including but not limited to video displays, posters and billboards), signs, signals, web pages, print media and streaming media data.

The term "research data" as used herein means data comprising (1) data concerning usage of media data, (2) data concerning exposure to media data, and/or (3) market research data.

The term "presentation data" as used herein means media data or content other than media data to be presented to a user.

The term "ancillary code" as used herein means data encoded in, added to, combined with or embedded in media data to provide information identifying, describing and/or characterizing the media data, and/or other information useful as research data.

The terms "reading" and "read" as used herein mean a process or processes that serve to recover research data that has been added to, encoded in, combined with or embedded in, media data.

The term "database" as used herein means an organized body of related data, regardless of the manner in which the data or the organized body thereof is represented. For example, the organized body of related data may be in the form of one or more of a table, a map, a grid, a packet, a datagram, a frame, a file, an e-mail, a message, a document, a report, a list or in any other form.

The term "network" as used herein includes both networks and internetworks of all kinds, including the Internet, and is not limited to any particular network or inter-network.

The terms "first", "second", "primary" and "secondary" are used to distinguish one element, set, data, object, step, process, function, activity or thing from another, and are not used to designate relative position, or arrangement in time or relative importance, unless otherwise stated explicitly.

The terms "coupled", "coupled to", and "coupled with" as used herein each mean a relationship between or among two or more devices, apparatus, files, circuits, elements, functions, operations, processes, programs, media, components, networks, systems, subsystems, and/or means, constituting any one or more of (a) a connection, whether direct or through one or more other devices, apparatus, files, circuits, elements, functions, operations, processes, programs, media, components, networks, systems, subsystems, or means, (b) a communications relationship, whether direct or through one or more other devices, apparatus, files, circuits, elements, functions, operations, processes, programs, media, components, networks, systems, subsystems, or means, and/or (c) a functional relationship in which the operation of any one or more devices, apparatus, files, circuits, elements, functions, operations, processes, programs, media, components, networks, systems, subsystems, or means depends, in whole or in part, on the operation of any one or more others thereof.

The terms "communicate," and "communicating" and as used herein include both conveying data from a source to a destination, and delivering data to a communications medium, system, channel, network, device, wire, cable, fiber, circuit and/or link to be conveyed to a destination and the term "communication" as used herein means data so conveyed or delivered. The term "communications" as used herein includes one or more of a communications medium, system, channel, network, device, wire, cable, fiber, circuit and link.

The term "processor" as used herein means processing devices, apparatus, programs, circuits, components, systems and subsystems, whether implemented in hardware, tangibly-embodied software or both, and whether or not programmable. The term "processor" as used herein includes, but is not limited to one or more computers, hardwired circuits, signal modifying devices and systems, devices and machines for controlling systems, central processing units, programmable devices and systems, field programmable gate arrays, application specific integrated circuits, systems on a chip, systems comprised of discrete elements and/or circuits, state machines, virtual machines, data processors, processing facilities and combinations of any of the foregoing.

The terms "storage" and "data storage" as used herein mean one or more data storage devices, apparatus, programs, circuits, components, systems, subsystems, locations and storage media serving to retain data, whether on a temporary or permanent basis, and to provide such retained data.

The present disclosure illustrates systems and methods for implementing audio encoding technology within a STB. Under various disclosed embodiments, one or more STBs are equipped with hardware and/or software to monitor an audience member's viewing and/or listening habits. The STBs are connected between a media device (e.g., television) and an external source of signal. In addition to converting a signal into content which is can be displayed on the television screen, the STB uses audio encoding technology to encode/decode the ancillary code within the source signal which can assist in producing research data.

By monitoring an audience member's media habits, the research data is manipulated where the media habits of one or more audience members can be reliably obtained to provide market information to advertisers, media distributors and the like which reveals the demographic characteristics of such audiences, along with information concerning the size of the audience. In certain embodiments, the technology may be used to simultaneously return applicable advertisements on a media device.

DETAILED DESCRIPTION

Figure 1A:
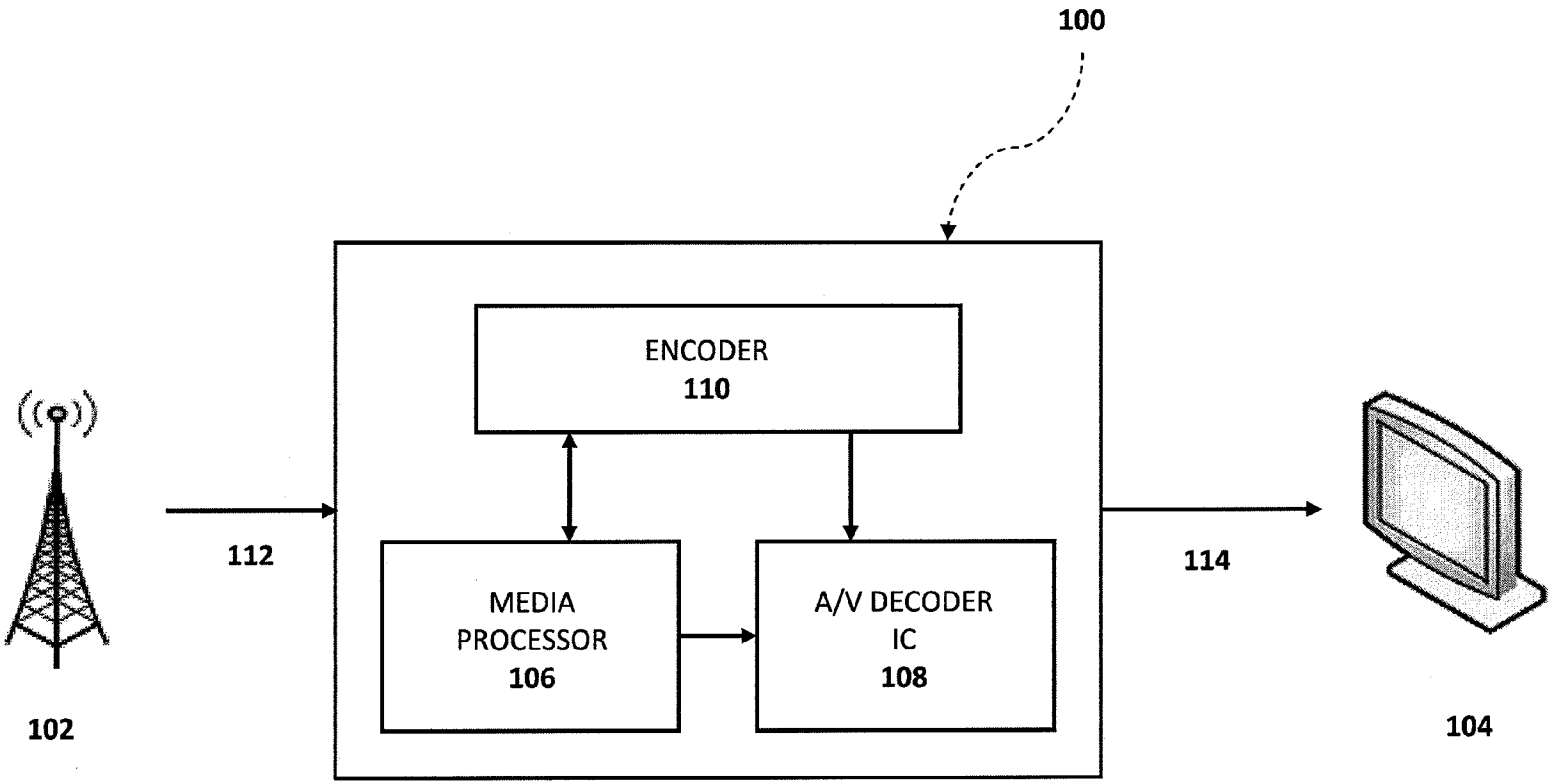
FIG. 1A is an exemplary functional block diagram of an encoder running On a STB.

Various embodiments of the present invention will be described herein below with reference to the accompanying drawings. In the following description, well-known functions or constructions are not described in detail since they would obscure the invention in unnecessary detail.

Under an exemplary embodiment, a system is implemented in a Set Top Box (STB) for gathering research data using encoding technology (e.g., CBET) concerning exposure of a user of the STB to audio and/or visual media. The present invention also relates to encoding and decoding broadcast or recorded segments such as broadcasts transmitted over the air, via cable, satellite or otherwise, and video, music or other works distributed on previously recorded media within the STB, as well as monitoring audience exposure to any of the foregoing. An exemplary process for gathering research data comprises transducing acoustic energy to audio data, receiving media data in non-acoustic form in a STB and producing research data based on the audio data and based on the media data and/or metadata of the media data.

The STB in the present disclosure relates to any consumer electronic devices capable to receive media/video content including digital video broadcast (DVB) standards and present the content to a user. In the case of video content, the development of IP networks and broadband/ADSL allow video content of good quality to be delivered as Internet Protocol television (IPTV) in the set-top boxes. Digital television may be delivered under a variety of DVB (Digital Video Broadcast) standards, such as DVB, DVB-S, DVB-S2, DVB-C, DVB-T and DVB-T2. The STB's may accept content from terrestrial, satellite, cable and/or streaming media via IP network.

An exemplary STB comprises a frontend which includes a tuner and a DVB demodulator. The frontend receives a raw signal from antenna or cable, and the signal is converted by the frontend into transport (MPEG) stream. Satellite equipment control (SEC) may also be provided in the case of satellite antenna setup. Additionally, a conditional access (CA) module or smartcard slot is provided to perform real-time decoding of encrypted transport stream. Demuxer filters incoming DVB stream and splits a transport stream into video and audio parts. The transport stream can contain some special streams like teletext or subtitles. Separated video and audio streams are preferably Numerous types of research operations are possible utilizing the STB technology, including, without limitation, television and radio program audience measurement wherein the broadcast signal is embedded with metadata. Because the STB is capable of monitoring any nearby encoded media, the STB may also be used to determine characteristics of received media and monitor exposure to advertising in various media, such as television, radio, internet audio, and even print advertising. For the desired type of media and/or market research operation to be conducted, particular activity of individuals is monitored, or data concerning their attitudes, awareness and/or preferences is gathered. In certain embodiments, research data relating to two or more of the foregoing are gathered, while in others only one kind of such data is gathered.

Turning to FIG. 1A, STB 100 is disclosed, comprising an encoder 110, media processor 106 and video decoder IC 108. STB 100 receives input 112 from a media source 102 which may be a cable, satellite, terrestrial and/or streaming media via an IP network. STB 100 outputs 114 encoded media to a media presentation device 104, which may be a television under one exemplary embodiment. The output may comprise coaxial cable output, optical output, composite video, S-Video, component video, HDMI/DVI, and/or any other suitable means for outputting media data. STB 100 comprises media processor 106, encoder 110, and video decoder IC 108. Media processor 106 is configured to perform media processing functions including, but not limited to, media tuning, automatic gain control, analog-to-digital conversion, along with any necessary forward error correction and demultiplexing to the incoming media signal received at input 112. Media processor 106 is communicatively coupled to A/V decoder IC 108 that digitizes and decodes baseband analog video into digital component video and also may convert audio waves into PCM digital code and/or decompress audio.

In the embodiment of FIG. 1A, encoder 110 is communicatively coupled to media processor 106 and A/V decoder 108 in STB 100. As incoming media is received by media processor 106, a an audio portion is forwarded to encoder 110 for encoding. During encoding, a number of preliminary operations are carried out in preparation for encoding one or more messages into audio data. First, the content of a message to be encoded is defined, where the message will typically characterize the media to be encoded. In certain embodiments this is achieved by selecting from a plurality of predefined messages, while in others the content of the message is defined through a user input or by data received from a further system (not shown). In still others the identity of the message content is fixed.

Once the content of the message is known, a sequence of symbols is assigned to represent the specific message. The symbols are selected from a predefined set of alphabet of code symbols. In certain embodiments the symbol sequences are preassigned to corresponding predefined messages. When a message to be encoded is fixed, as in a station ID message, encoding operations may combined to define a single invariant message symbol sequence. Subsequently, a plurality of substantially single-frequency code components are assigned to each of the message symbols.

When the message is encoded, each symbol of the message is represented in the audio data by its corresponding plurality of substantially single-frequency code components. Each of such code components occupies only a narrow frequency band so that it may be distinguished from other such components as well as noise with a sufficiently low probability of error. It is recognized that the ability of an encoder or decoder to establish or resolve data in the frequency domain is limited, so that the substantially single-frequency components are represented by data within some finite or narrow frequency band. Moreover, there are circumstances in which is advantageous to regard data within a plurality of frequency bands as corresponding to a substantially single-frequency component. This technique is useful where, for example, the component may be found in any of several adjacent bands due to frequency drift, variations in the speed of a tape or disk drive, or even as the result of an incidental or intentional frequency variation inherent in the design of a system.

In addition, digitized audio signals are supplied to encoder 110 for masking evaluation, pursuant to which the digitized audio signal is separated into frequency components, for example, by Fast Fourier Transform (FFT), wavelet transform, or other time-to-frequency domain transformation, or else by digital filtering. Thereafter, the masking abilities of audio signal frequency components within frequency bins of interest are evaluated for their tonal masking ability, narrow band masking ability and broadband masking ability (and, if necessary or appropriate, for non-simultaneous masking ability). Alternatively, the masking abilities of audio signal frequency components within frequency bins of interest are evaluated with a sliding tonal analysis.

More specific information regarding the encoding process described above, along with several advantageous and suitable techniques for encoding audience measurement data in audio data are disclosed in U.S. Pat. No. 7,640,141 to Ronald S. Kolessar and U.S. Pat. No. 5,764,763 to James M. Jensen, et al., which are assigned to the assignee of the present application, and which are incorporated by reference in their entirety herein. Other appropriate encoding techniques are disclosed in U.S. Pat. No. 5,579,124 to Aijala, et al., U.S. Pat. Nos. 5,574,962, 5,581,800 and 5,787,334 to Fardeau, et al., U.S. Pat. No. 5,450,490 to Jensen, et al., and U.S. Pat. No. 6,871,180, in the names of Neuhauser, et al., each of which is assigned to the assignee of the present application and all of which are incorporated herein by reference in their entirety.

Data to be encoded is received and, for each data state corresponding to a given signal interval, its respective group of code components is produced, and subjected to level adjustment and relevant masking evaluations. Signal generation may be implemented, for example, by means of a look-up table storing each of the code components as time domain data or by interpolation of stored data. The code components can either be permanently stored or generated upon initialization of the STB 100 and then stored in memory, such as in RAM, to be output as appropriate in response to the data received. The values of the components may also be computed at the time they are generated.

Level adjustment is carried out for each of the code components based upon the relevant masking evaluations as discussed above, and the code components whose amplitude has been adjusted to ensure inaudibility are added to the digitized audio signal. Depending on the amount of time necessary to carry out the foregoing processes, it may be desirable to delay the digitized audio signal by temporary storage in memory. If the audio signal is not delayed, after an FFT and masking evaluation have been carried out for a first interval of the audio signal, the amplitude adjusted code components are added to a second interval of the audio signal following the first interval. If the audio signal is delayed, however, the amplitude adjusted code components can instead be added to the first interval and a simultaneous masking evaluation may thus be used. Moreover, if the portion of the audio signal during the first interval provides a greater masking capability for a code component added during the second interval than the portion of the audio signal during the second interval would provide to the code component during the same interval, an amplitude may be assigned to the code component based on the non-simultaneous masking abilities of the portion of audio signal within the first interval. In this fashion both simultaneous and non-simultaneous masking capabilities may be evaluated and an optimal amplitude can be assigned to each code component based on the more advantageous evaluation.

In certain applications, such as in broadcasting, or analog recording (as on a conventional tape cassette), the encoded audio signal in digital form is converted to analog form by a digital-to-analog converter (DAC) discussed below in connection with FIG. 4. However, when the signal is to be transmitted or recorded in digital form, the DAC may be omitted.

Still other suitable encoding techniques are the subject of PCT Publication WO 00/04662 to Srinivasan, U.S. Pat. No. 5,319,735 to Preuss, et al., U.S. Pat. No. 6,175,627 to Petrovich, et al., U.S. Pat. No. 5,828,325 to Wolosewicz, et al., U.S. Pat. No. 6,154,484 to Lee, et al., U.S. Pat. No. 5,945,932 to Smith, et al., PCT Publication WO 99/59275 to Lu, et al., PCT Publication WO 98/26529 to Lu, et al., and PCT Publication WO 96/27264 to Lu, et al, all of which are incorporated herein by reference.

In certain embodiments, the encoder 110 forms a data set of frequency-domain data from the audio data and the encoder processes the frequency-domain data in the data set to embed the encoded data therein. Where the codes have been formed as in the Jensen, et al. U.S. Pat. No. 5,764,763 or U.S. Pat. No. 5,450,490, the frequency-domain data is processed by the encoder 25 to embed the encoded data in the form of frequency components with predetermined frequencies. Where the codes have been formed as in the Srinivasan PCT Publication WO 00/04662, in certain embodiments the encoder processes the frequency-domain data to embed code components distributed according to a frequency-hopping pattern. In certain embodiments, the code components comprise pairs of frequency components modified in amplitude to encode information. In certain other embodiments, the code components comprise pairs of frequency components modified in phase to encode information. Where the codes have been formed as spread spectrum codes, as in the Aijala, et al. U.S. Pat. No. 5,579,124 or the Preuss, et al. U.S. Pat. No. 5,319,735, the encoder comprises an appropriate spread spectrum encoder.

The media measurement arrangements in FIG. 1A, as well as the other embodiments detailed below, are particularly advantageous for identifying audience and content in STBs as the configuration takes advantage of the advanced design, performance and scalability of STBs. Additionally STBs can also be remotely reprogrammed for new configurations, updates, upgrades and applications. Conventional STBs may be modified by software and/or hardware changes to carry out a research operation. In alternate embodiments, STBs are redesigned and substantially reconstructed for this purpose. In certain embodiments, the STB itself is operative to gather research data. In certain embodiments, the STB emits data that causes another device to gather research data. In certain embodiments, the STB is operative both to gather research data and to emit data that causes another device to gather research data. In certain embodiments, the STB wirelessly, or using wires, communicates (e.g. a wireless internet connection or other computer network) the research data with a service server.

Another advantage of integrating encoding in a STB is that encoding may be performed directly at the source in real-time, thus reducing or eliminating the need to encode at the station or broadcaster. This allows cable providers, satellite TV network and STB manufacturers to provide download capability of the encoding application and the encoding engine over the air to a user's STB. In such an embodiment, the STB would have access to a look up table in which a unique code is assigned for each TV channel. During Broadcast, the encoder, operating at the video decoder output level, will encode the incoming broadcast signal for that channel. It is also possible to determine which channel was being viewed by embedding a different code for each channel. Further, by embedding both the encoder and the decoder the STB allows for real time encoding. In this embodiment, the output signal to the TV may be simultaneously decoded in real time. In this embedment, data is saved in a dedicated memory/storage, and communicated from the STB to the central media monitoring server for analysis.

Since many STBs are "on" even when the audio-visual device is "off", encoding the audio signal allows media monitoring organizations to determine whether the media device (e.g., television) is on by decoding the room audio. This can be accomplished by using either a personal people meter (PPM™) worn by a panelist, by an embedded decoder in the STB, or by having a decoder and microphone connected to the STB via USB. As an alternative embodiment, the encoder and decoder are housed in a dedicated box that is connected between the STB and the audio-visual device (e.g. a TV). The ultimate results are the same except that in this case the encoder/decoder are in their own box rather than integrated with a STB. This may be advantageous in applications where STBs are not necessary for the audience members media viewing, such as over the air TV broadcast. In all embodiments, if the source signal has been previously encoded, the decoder will identify the source and program content to complement STB's channel identification.

Accordingly, an encoder running on a STB has a number of advantages, in that the configuration can determine whether or not TV is "on", identify person level demographics for those wearing a portable device (e.g., PPM), provides the capability to the STB manufacturer or service providers to target specific channels or programs be encoded or decoded by codes, perform real-time encoding of program segments, perform transparently to the audience member, allows for the creation of a "mega panel" due to the number of existing STBs in use, and the STB has many existing hardware and software technological advantages for gathering data (e.g., the STBs are Wi-Fi/Bluetooth enabled).

Figure 1B:
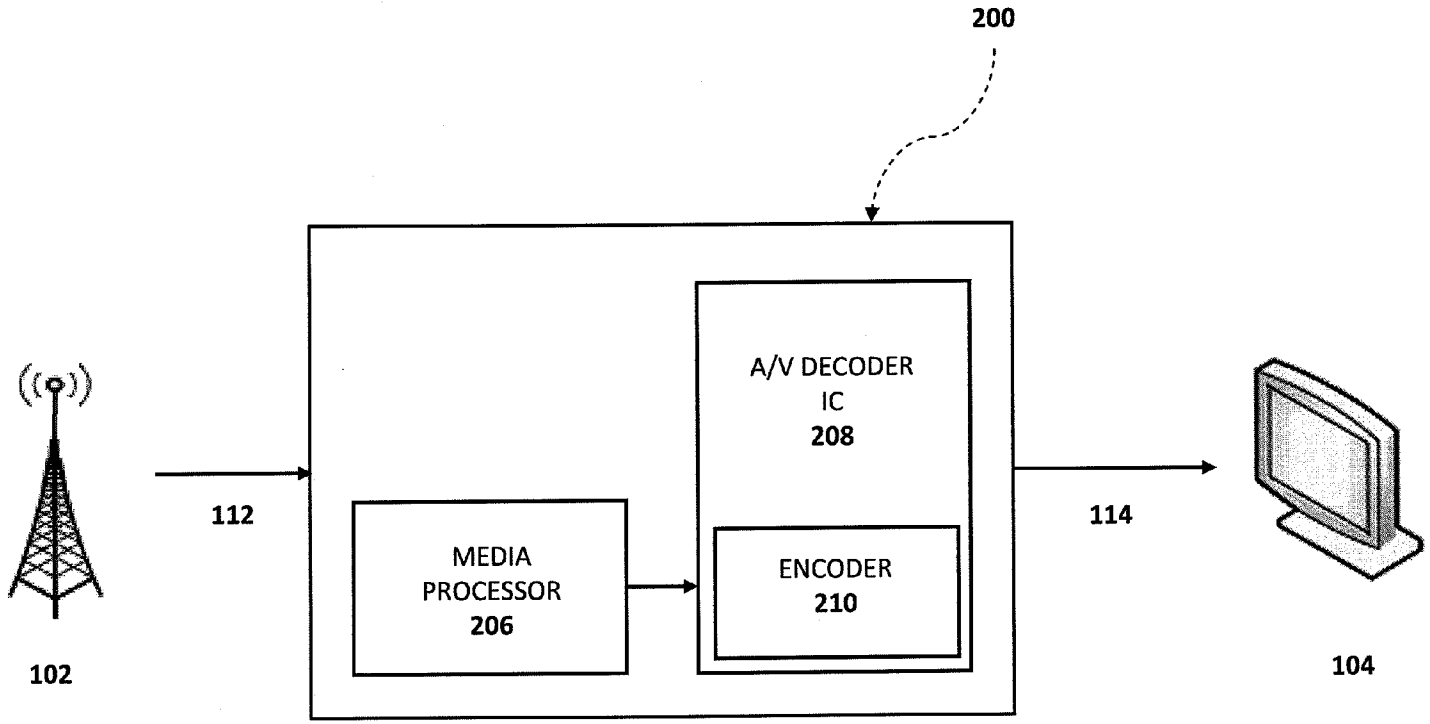
FIG. 1B is an exemplary functional block diagram of an encoder running on the Video Decoder Chip.
Figure 1C:
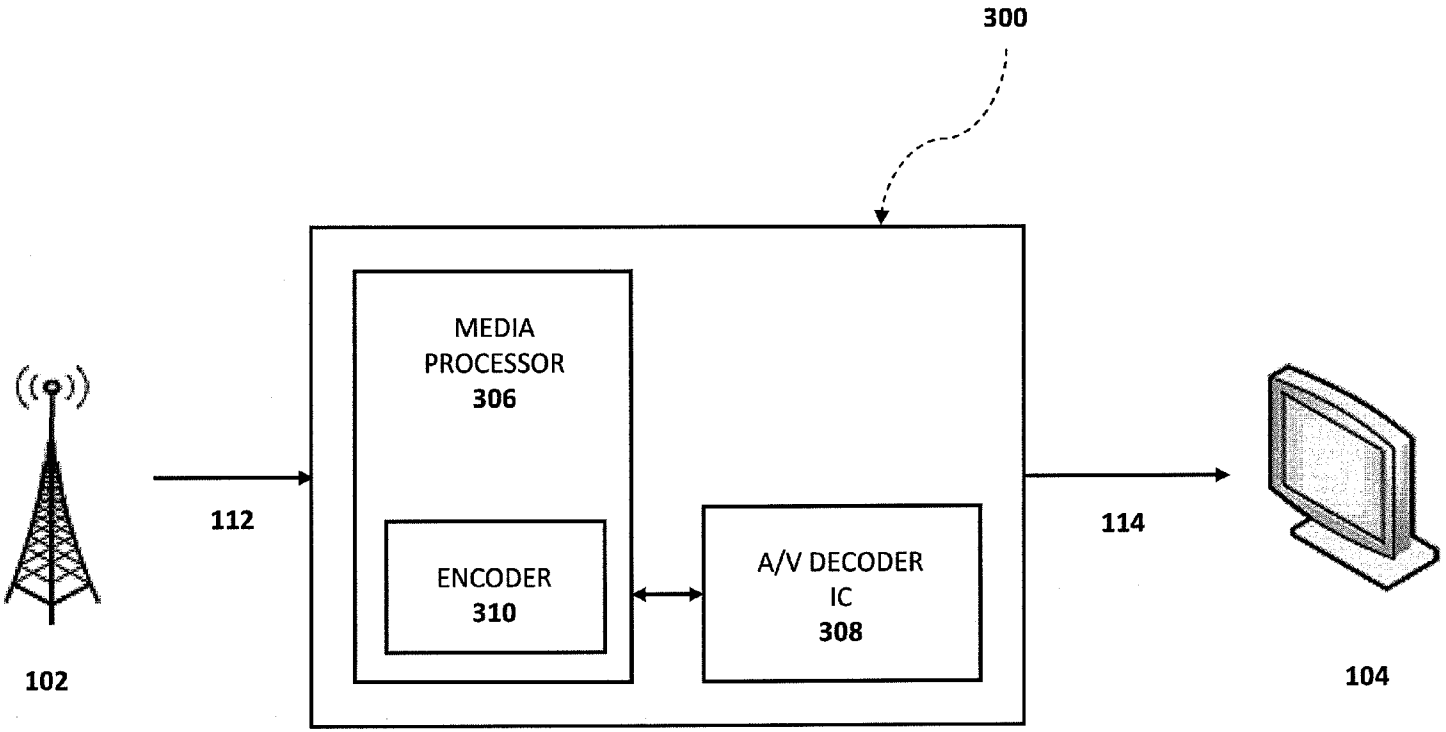
FIG. 1C is an exemplary functional block diagram of an encoder running on a media processor CPU.

In an alternate embodiment illustrated in FIG. 1B, STB 200 is arranged where encoder 210 (which has similar operative characteristics as encoder 110 in FIG. 1A) is incorporated within A/V decoder IC 208. Just as in FIG. 1A, the STB can provide the viewer with the program info (channel, program) as well as pulse-code modulation (PCM) audio. The encoder engine inserts appropriate codes in the audio and returns it back to the STB controller. Using principles of psychoacoustic masking discussed above, encoder 210 inserts tones into the audio spectrum of the station or network's source signal and the STB 200 communicates the encoded signal to an audio-visual device 104 (e.g. a television) via communication interface 114 (e.g. Coaxial Cable, Optical, Composite Video, S-Video, Component Video, HDMI/DVI, or a wireless means). The audio-visual device then displays the encoded broadcast signal which may have the capability to display meta-data such as the programming information. If necessary, encoder 210 may also serve the function of decoding a previously encoded signal. In still another exemplary embodiment, FIG. 1C illustrates a STB 300 where encoder 310 of FIGS. 1A-B, is embedded on the media processor 306. Encoded audio is forwarded to A/V decoder 108 and transmitted 114 to a user's media device 104.

Figure 2:
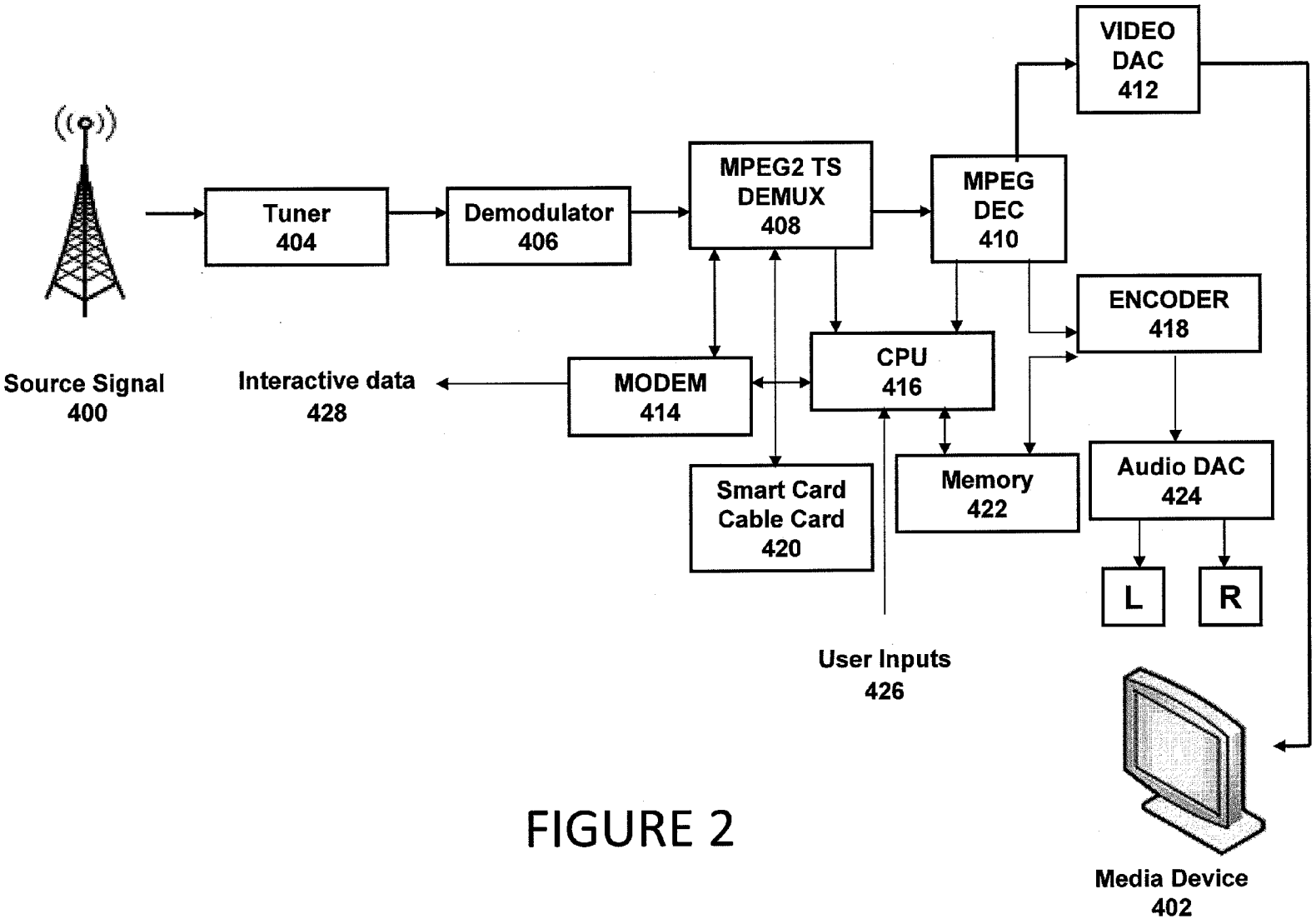
FIG. 2 is an exemplary diagram of an encoding process running On a STB.

Turning to the exemplary embodiment in FIG. 2, a more detailed illustration of a STB, similar to the ones illustrated in FIGS. 1A-C, is shown. Here, a CPU 416 controls and/or communicates directly/indirectly with demultiplexer 408, decoder 410, modem 414, card reader 410, memory 422, video digital-to-analog converter (DAC) 412, audio DAC 424 and encoder 418. While tuner 404 receives media from source signal 400, modem 414 accepts interactive or other data 428 received from a computer-based network. Card reader 420 accepts smart cards and/or cable cards for identifying a user and for allowing the user to further interact with the set-top box, either alone, or in conjunction with user inputs 426, which may be a keyboard, infrared device, track ball, etc.

As a source signal is received 400, tuner 404 down-converts the incoming carrier to an intermediate frequency (IF). The IF signal is demodulated into in-phase ("I") and quadrature phase ("Q") carrier components which are then A-D converted into a plurality of multi-bit data streams (e.g., 6-bit) for digital demodulation 406 and subsequent processing such as forward-error correction (FEC) in which the Reed-Solomon check/correction, de-interleaving and Viterbi decoding are carried out. A resulting transport stream is then forwarded to demultiplexer 408 which has responsibility for transmitting signals to respective video and audio (MPEG) decoders (410).

Decoder 410 is responsible for composing a continuous moving picture from the received frames from demultiplexer 408. Additionally, decoder 410 performs necessary data expansion, inverse DCT, interpolation and error correction. The reconstituted frames may be built up inside the decoder's DRAM (not show), or may also use memory 422. Decoder 410 outputs a pulse train containing the necessary A/V data (e.g., Y, Cr and Cb values for the pixels in the picture), which is communicated to video DAC 412 for conversion (and possible PAL encoding, if necessary).

In addition, decoder 410 forwards audio to encoder 418, which encodes audio data prior to converting audio in Audio DAC 424 and presenting the audio (L-R) and/or video to media device 402. In certain embodiments, encoder 418 embeds audience measurement data in the audio data, and may be embodied as software running on the STB, including embodiments in which the encoding software is integrated or coupled with another player running on the system of FIG. 2. In alternate embodiments, encoder 418 may comprise a device coupled with the STB such as a peripheral device, or a board, such as a soundboard. In certain embodiments, the board is plugged into an expansion slot of the STB. In certain embodiments, the encoder 418 is programmable such that it is provided with encoding software prior to coupling with the user system or after coupling with the user system. In these embodiments, the encoding software is loaded from a storage device or from the audio source or another source, or via another communication system or medium.

In certain embodiments, the encoder 418 encodes audience measurement data as a further encoded layer in already-encoded audio data, so that two or more layers of embedded data are simultaneously present in the audio data. The layers should be arranged with sufficiently diverse frequency characteristics so that they may be separately detected. In certain of these embodiments the code is superimposed on the audio data asynchronously. In other embodiments, the code is added synchronously with the preexisting audio data. In certain ones of such synchronous encoding embodiments data is encoded in portions of the audio data which have not previously been encoded. At times the user system receives both audio data (such as streaming media) and audience measurement data (such as source identification data) which, as received, is not encoded in the audio data but is separate therefrom. In certain embodiments, the STB may supply such audience measurement data to the encoder 418 which serves to encode the audio data therewith.

Under one embodiment, the audience measurement data is source identification data, content identification code, data that provides information about the received audio data, demographic data regarding the user, and/or data describing the user system or some aspect thereof, such as the user agent (e.g. player or browser type), operating system, sound card, etc. The audience measurement data can also include an identification code. In certain embodiments for measuring exposure of any audience member to audio data obtained from the Internet, such as streaming media, the audience measurement data comprises data indicating that the audio data was obtained from the Internet, the type of player and/or source identification data.

Figure 3A:
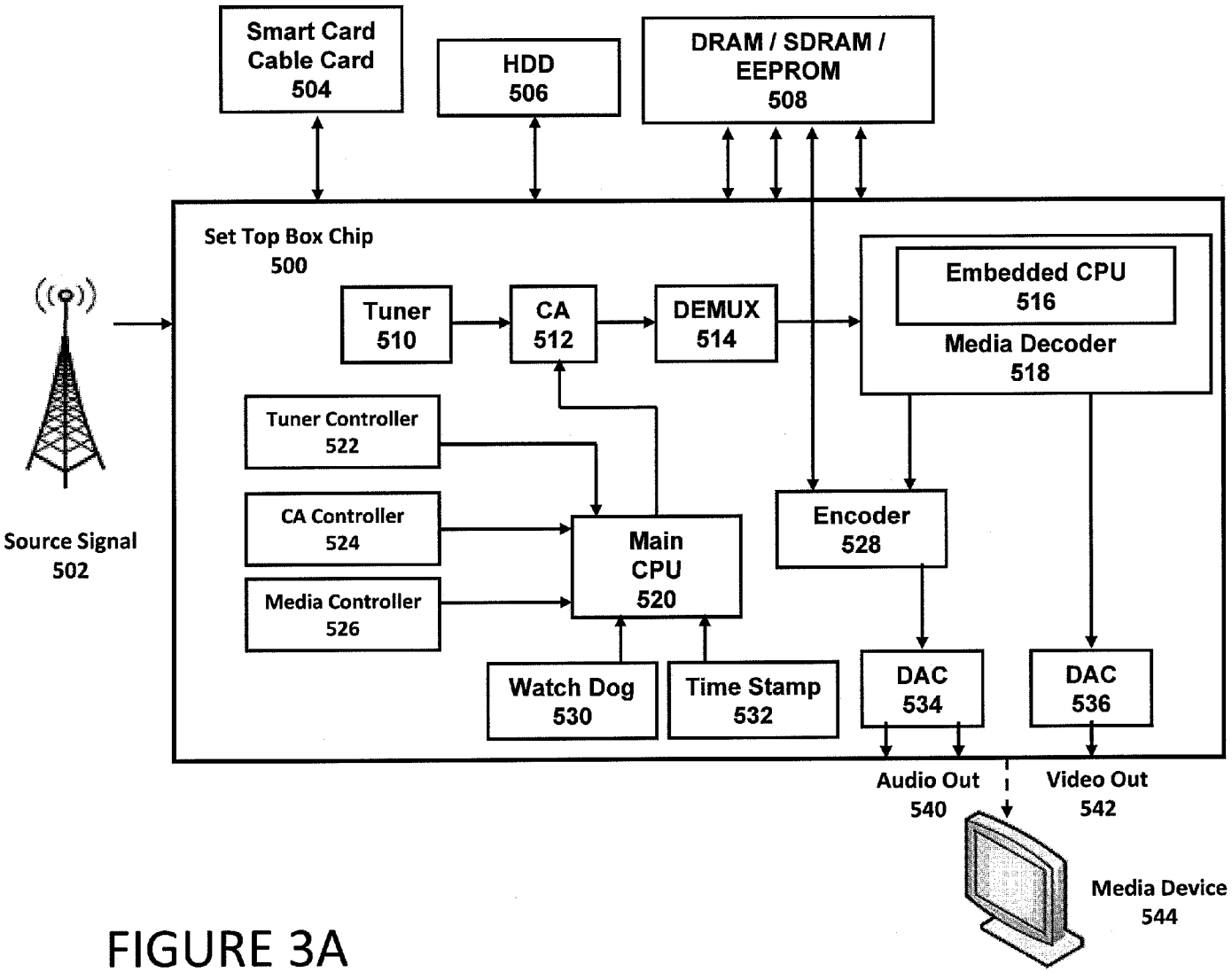
FIG. 3A is an exemplary block diagram overview of an encoder running on a main CPU.

FIG. 3A illustrates an embodiment of an encoder (528) running off of the main CPU of set top box (STB) chip 500. Similar to FIG. 2, a source signal 502 is received at one or more inputs of STB chip 500 (not shown). STB chip 500 is also communicatively coupled to smart card/cable card input 504, hard drive (HDD) 506 and DRAM/SDRAM/EEPROM memory 508. It is understood by those having ordinary skill in the art that the aforementioned features may be integrated in STB chip 500 as well. Source signal 502 is received at tuner block 510, which performs down-conversion and further communicates with conditional access (CA) block 512 to perform real-time decoding of encrypted transport stream.

CA block 512 is communicatively coupled with main CPU 520, which in turn processes controller data provided by tuner controller 522, CA controller 524 and media controller 526. Additionally, main CPU 520 also may receive inputs from watch dog timer 530 and time stamp 532. After down-conversion from tuner 510, the incoming carrier for source signal 502 is demodulated and A-D converted into a plurality of multi-bit data streams for digital demodulation and subsequent processing. A resulting transport stream is then forwarded to demultiplexer 514 which has responsibility for transmitting signals to media decoder 518, which, in the embodiment of FIG. 3A, is powered by embedded CPU 516.

Media Decoder 518 processes a stream from demultiplexer 514 is responsible for composing a continuous moving picture from the received frames from demultiplexer 408. Additionally, decoder 410 performs necessary data expansion, inverse DCT, interpolation and error correction. The reconstituted frames may be built up inside the decoder's DRAM 508 or other suitable memory. Decoder 518 outputs a pulse train containing the necessary A/V data, which is communicated to video DAC 536 for conversion and output 542 to media device 544.

Decoder 518 forwards audio to encoder 528, which encodes audio data prior to converting audio in Audio DAC 534 and presenting the audio (L-R) to media device 544. Just as described above in connection with FIG. 2, encoder 528 embeds audience measurement data in the audio data, and may be embodied as software running on the STB chip, including embodiments in which the encoding software is integrated or coupled with another player running on the system of FIG. 2. In alternate embodiments, encoder 528 may comprise a device coupled with the STB chip such as a peripheral device, or a board. In certain embodiments, encoder 528 is programmable such that it is provided with encoding software prior to coupling with the user system or after coupling with the user system. In these embodiments, the encoding software is loaded from a storage device or from the audio source or another source, or via another communication system or medium.

Figure 3B:
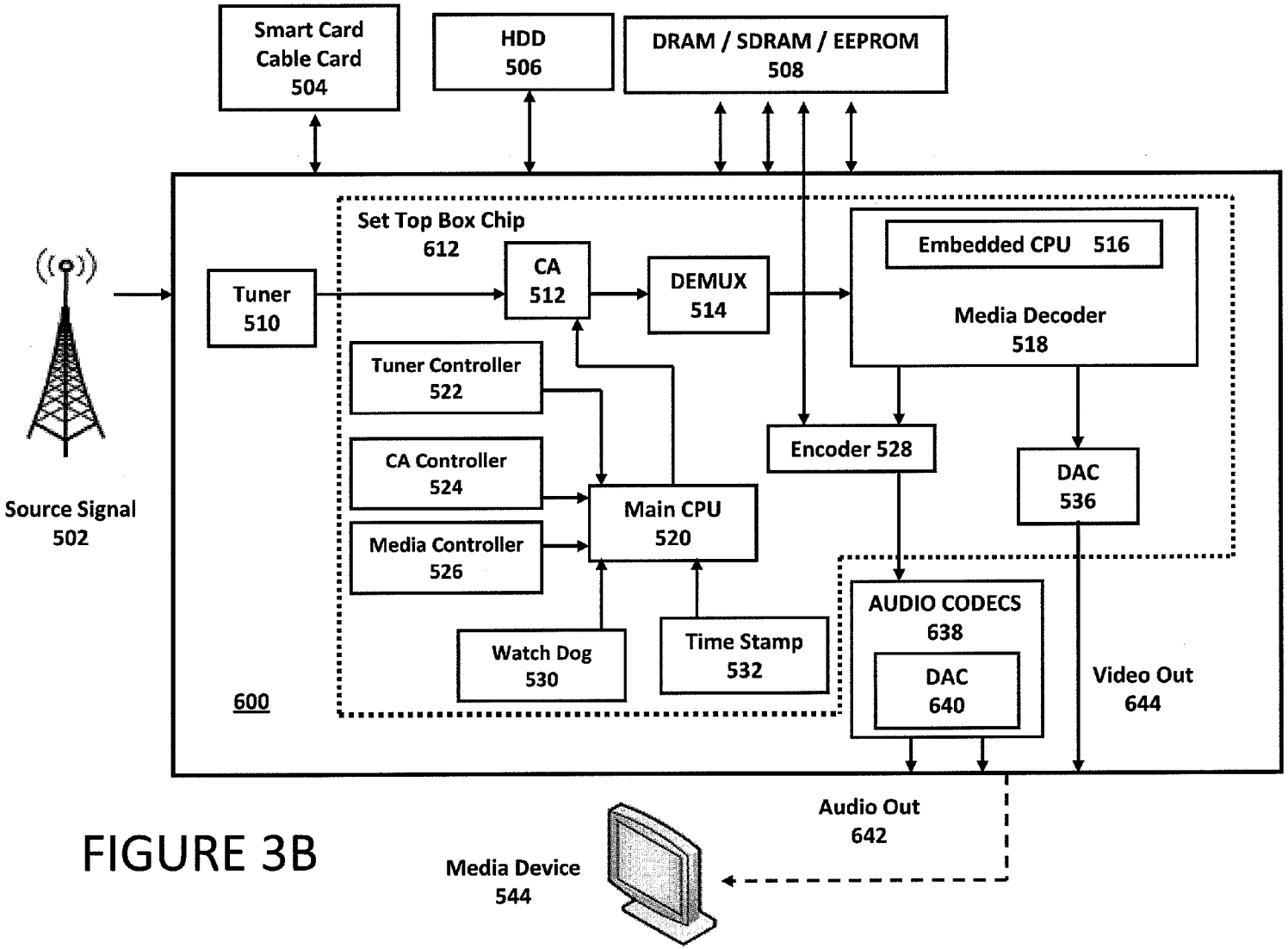
FIG. 3B is an exemplary state diagram of an encoder running in a STB according to one embodiment.

FIG. 3B illustrates an alternate embodiment from the one disclosed in FIG. 3A, where STB chip 612 of STB 600 is separate from tuner 510. Additionally, digital-analog converter 640 is provided in audio codec block 638, which is communicatively coupled to STB chip 612. Codec 638 may be lossy or lossless, and may be configured to accept a wide variety of container formats, such as Ogg, ASF, DivX, as well as containers defined as ISO standards, such as MPEG transport stream, MPEG program stream, MP4 and ISO base media file format. The embodiment of FIG. 3B may be particularly advantageous in cases where multimedia data is received through a packetized network, or otherwise requires compression/decompression for playback.

Figure 4:
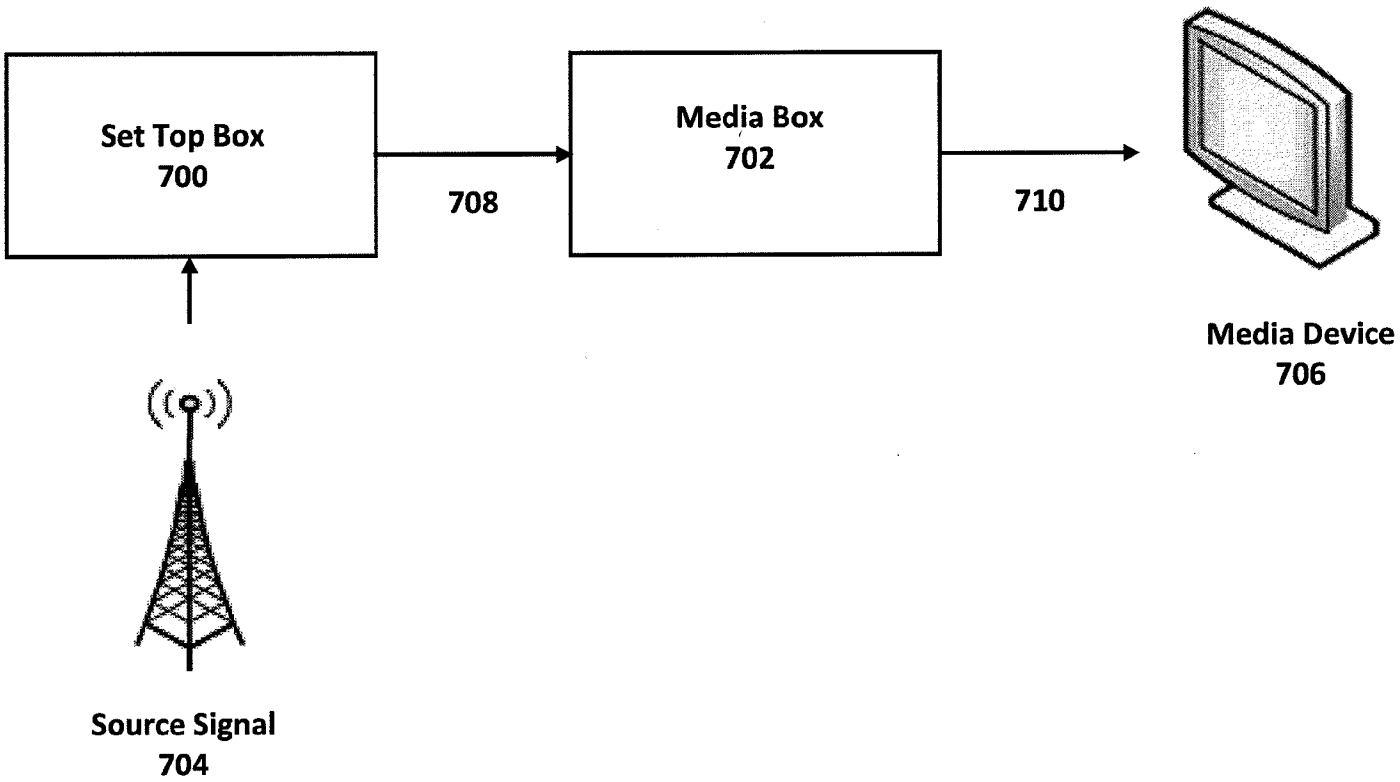
FIG. 4 is an exemplary block diagram of a media box under an alternate embodiment.

FIG. 4 illustrates yet another embodiment, where the encoder illustrated in any of FIGS. 1A-3B is embodied in a media box 702, which is communicatively coupled between STB 700 and media device 706. In this embodiment, media box 702 is a dedicated box that encapsulates a small version of the encoder and/or decoder. A source signal 704 (e.g. CATV, satellite, antenna, Ethernet or another broadcasting method) is communicated via communication means to a STB 700 which processes the signal to produce a format compatible with the media device 706. The signal from the STB 700 is communicated to the media box 702 where the signal may be encoded or decoded prior to being communicated to the media device where the media is reproduced.

Figure 5A:
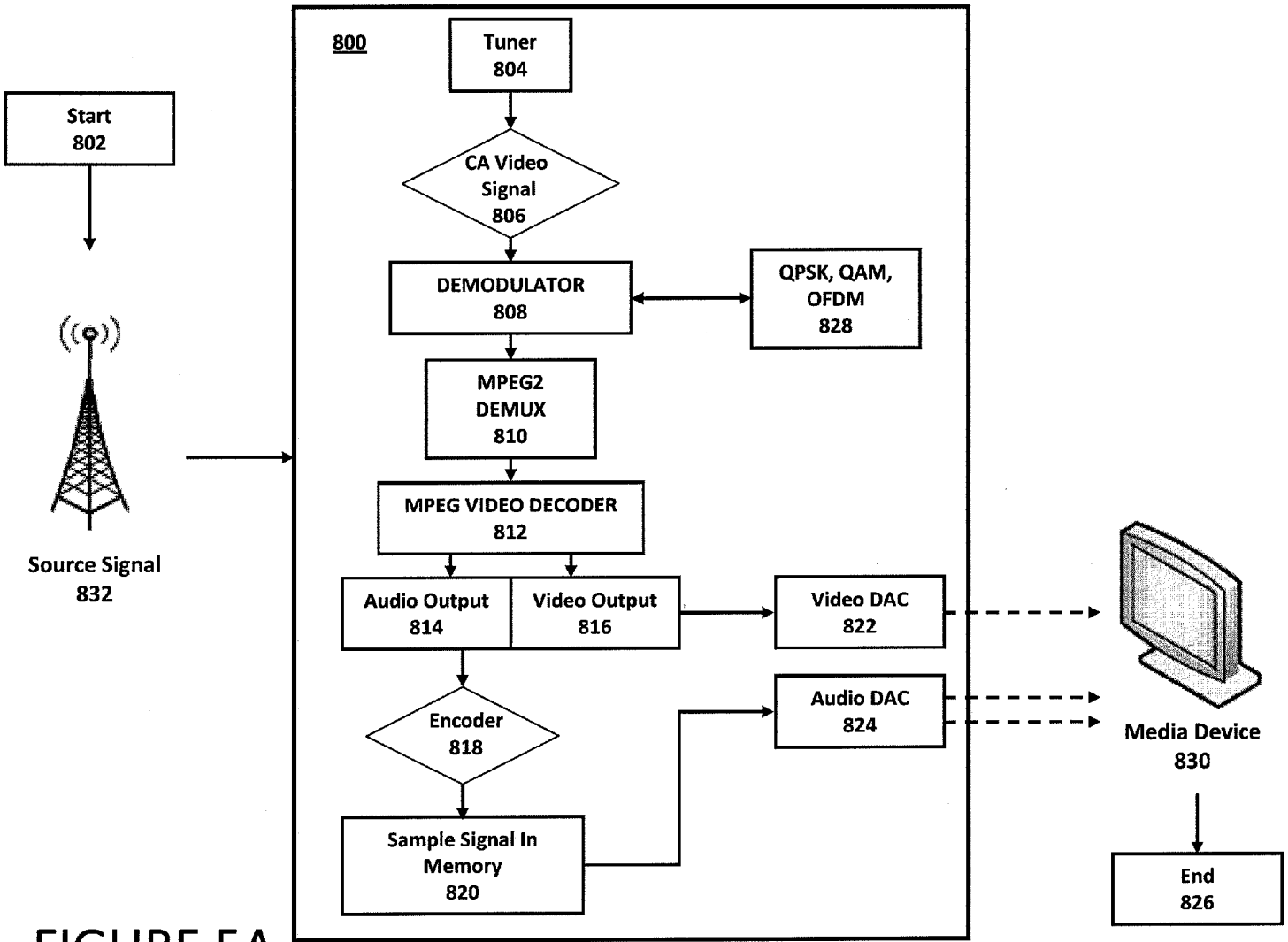
FIG. 5A is an exemplary diagram of an encoder running in a STB according to one embodiment.

FIG. 5A discloses an exemplary encoding process, where, at the start 802 of an encoding process, source signal 832 is received in STB 800, where tuner 804 down-converts the incoming carrier to an intermediate frequency (IF). The IF signal undergoes conditional access processing 806 and is demodulated 808 into "I" and "Q" carrier components 828 which are then A-D converted demultiplexed 810, where the resulting signals are transmitted to decoder 812, which produces audio output 814 and video output 816. Video output is converted 822 and combined with audio prior to reproduction on media device 830. Audio output 814 is provided to encoder 818, which operates similarly to the encoders described above in connection with FIGS. 1A-3B. A portion of the encoded audio is sampled 820 (e.g., 8K sample signal) prior to forwarding the encoded audio to audio DAC module 824. The sampled audio may subsequently be used for audio matching and/or signature extraction within the STB or at a remote location.

Figure 5B:
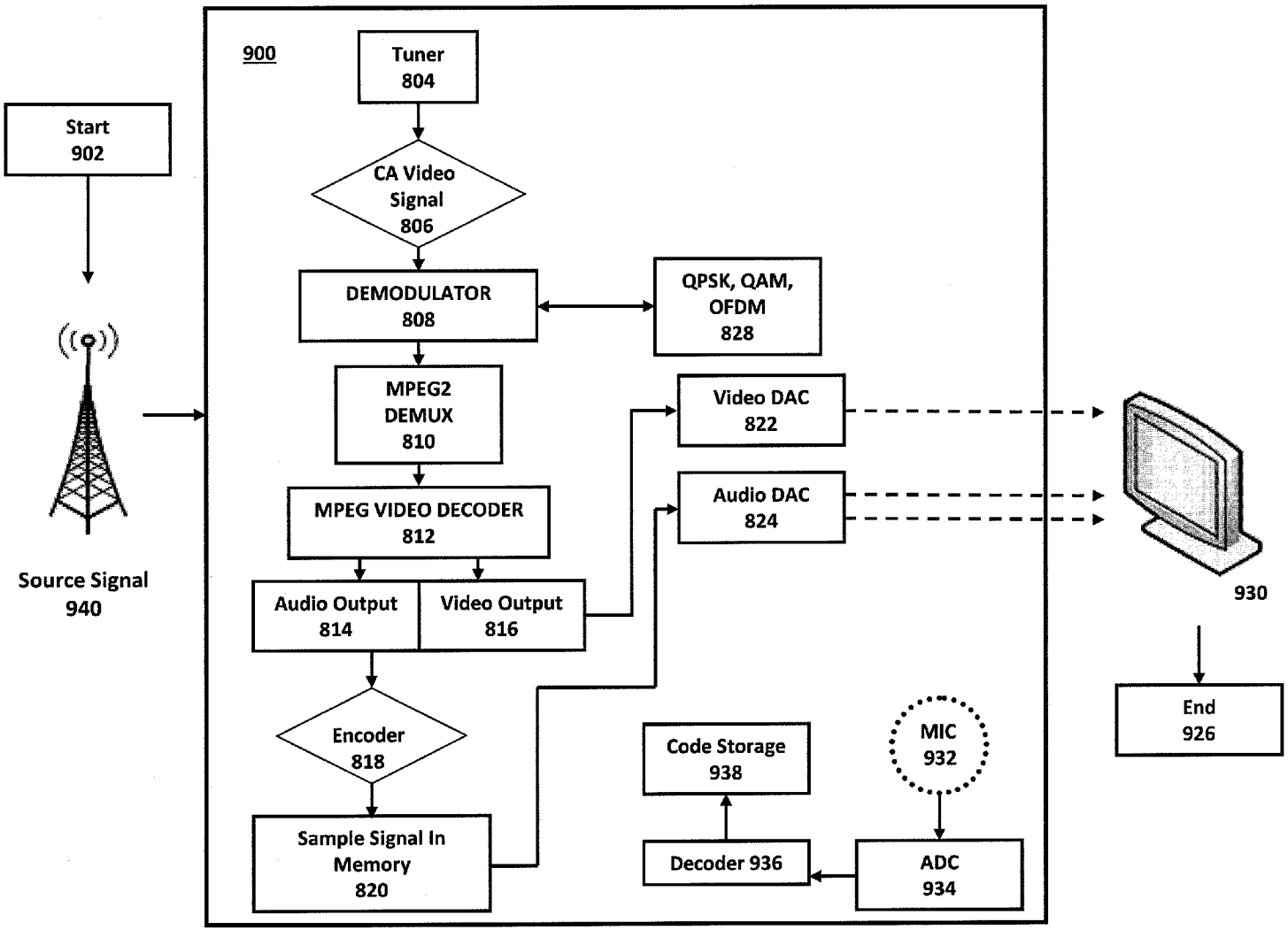
FIG. 5B is an exemplary diagram of an encoder and decoder running in a STB.

FIG. 5B illustrates another embodiment of the process in FIG. 5A, where a microphone 932 is provided on the STB. Acoustic energy is detected by microphone (transducer) 932 and translated into detected audio data. Decoder 936 serves to decode the encoded data present in the detected audio data. The decoded data is either stored in an internal storage 938 to be communicated at a later time or else communicated from the STB 900 once decoded. In other embodiments, the STB 900 provides the detected audio data or a compressed version thereof to a storage device 938 for decoding elsewhere. The storage device 938 may be internal to the STB 900 as depicted in FIG. 5B, or the storage device may be external to the STB 900 and coupled therewith to receive the data to be recorded. In still further embodiments, STB 900 receives and communicates audio data or a compressed version thereof to another device for subsequent decoding. In certain embodiments, the audio data is compressed by forming signal-to-noise ratios representing possible code components, such as in U.S. Pat. No. 5,450,490 or U.S. Pat. No. 5,764,763 both of which are assigned to the assignee of the present invention and are incorporated herein by reference in their entirety. The data to be decoded in certain embodiments may include data already encoded in the audio data when received by the user system, data encoded in the audio data by the user system, or both.

There are several possible embodiments of decoding techniques that can be implemented for use in the present invention. Several advantageous techniques for detecting encoded audience measurement data are disclosed in U.S. Pat. No. 5,764,763 to James M. Jensen, et al., which is assigned to the assignee of the present application, and which is incorporated by reference herein. Other appropriate decoding techniques are disclosed in U.S. Pat. No. 5,579,124 to Aijala, et al., U.S. Pat. Nos. 5,574,962, 5,581,800 and 5,787,334 to Fardeau, et al., U.S. Pat. No. 5,450,490 to Jensen, et al., and U.S. patent application Ser. No. 09/318,045, in the names of Neuhauser, et al., each of which is assigned to the assignee of the present application and all of which are incorporated herein by reference.

Still other suitable decoding techniques are the subject of PCT Publication WO 00/04662 to Srinivasan, U.S. Pat. No. 5,319,735 to Preuss, et al., U.S. Pat. No. 6,175,627 to Petrovich, et al., U.S. Pat. No. 5,828,325 to Wolosewicz, et al., U.S. Pat. No. 6,154,484 to Lee, et al., U.S. Pat. No. 5,945,932 to Smith, et al., PCT Publication WO 99/59275 to Lu, et al., PCT Publication WO 98/26529 to Lu, et al., and PCT Publication WO 96/27264 to Lu, et al., all of which are incorporated herein by reference.

In certain embodiments, decoding is carried out by forming a data set from the audio data collected by the portable monitor 100 and processing the data set to extract the audience measurement data encoded therein. Where the encoded data has been formed as in U.S. Pat. No. 5,764,763 or U.S. Pat. No. 5,450,490, the data set is processed to transform the audio data to the frequency domain. The frequency domain data is processed to extract code components with predetermined frequencies. Where the encoded data has been formed as in the Srinivasan PCT Publication WO 00/04662, in certain embodiments the remote processor 160 processes the frequency domain data to detect code components distributed according to a frequency-hopping pattern. In certain embodiments, the code components comprise pairs of frequency components modified in amplitude to encode information which are processed to detect such amplitude modifications. In certain other embodiments, the code components comprise pairs of frequency components modified in phase to encode information and are processed to detect such phase modifications. Where the codes have been formed as spread spectrum codes, as in the Aijala, et al. U.S. Pat. No. 5,579,124 or the Preuss, et al. U.S. Pat. No. 5,319,735, an appropriate spread spectrum decoder is employed to decode the audience measurement data.

Figure 5C:
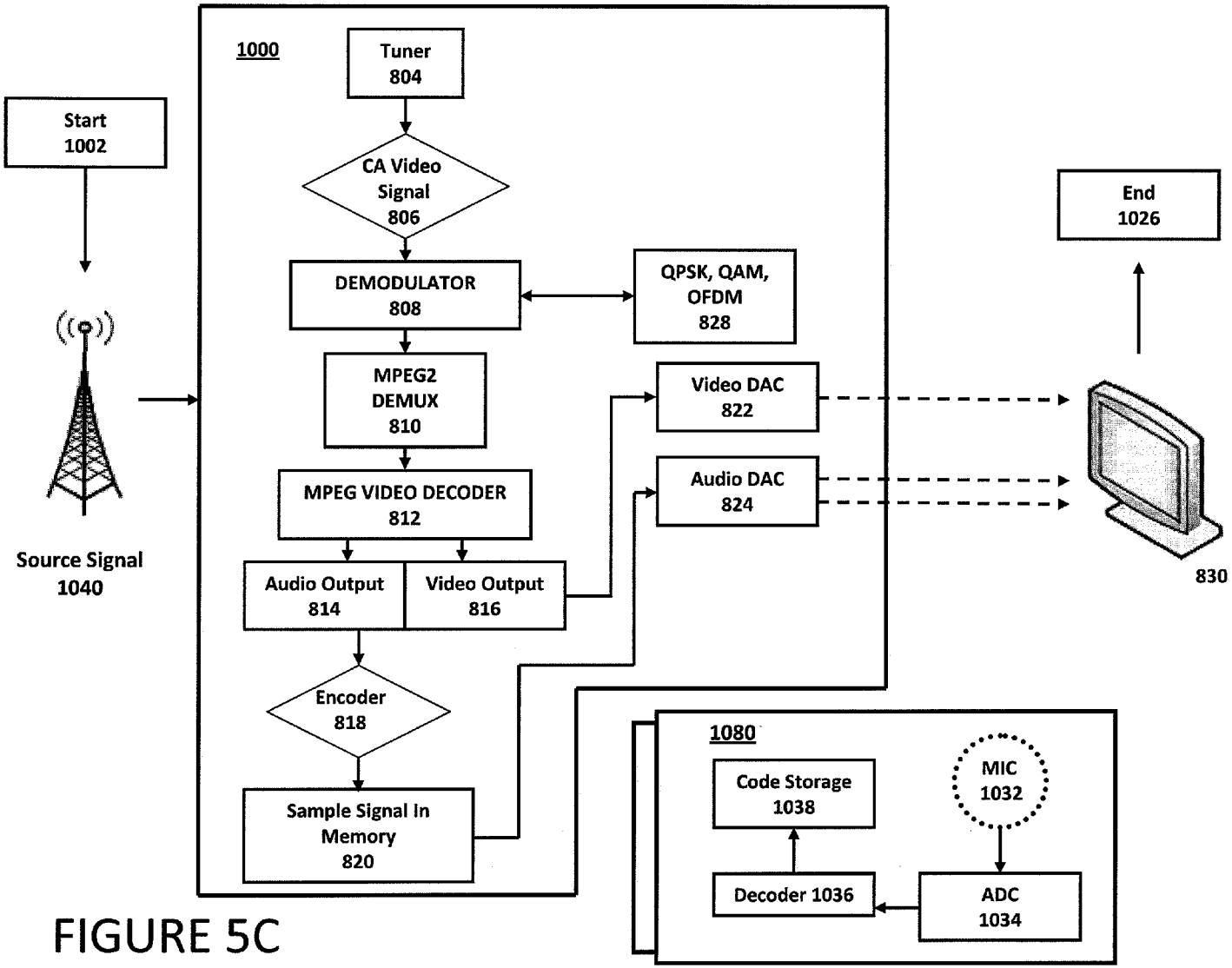
FIG. 5C is an exemplary diagram of an encoder running inside the STB and a decoder on external USB stick.
Figure 5D:
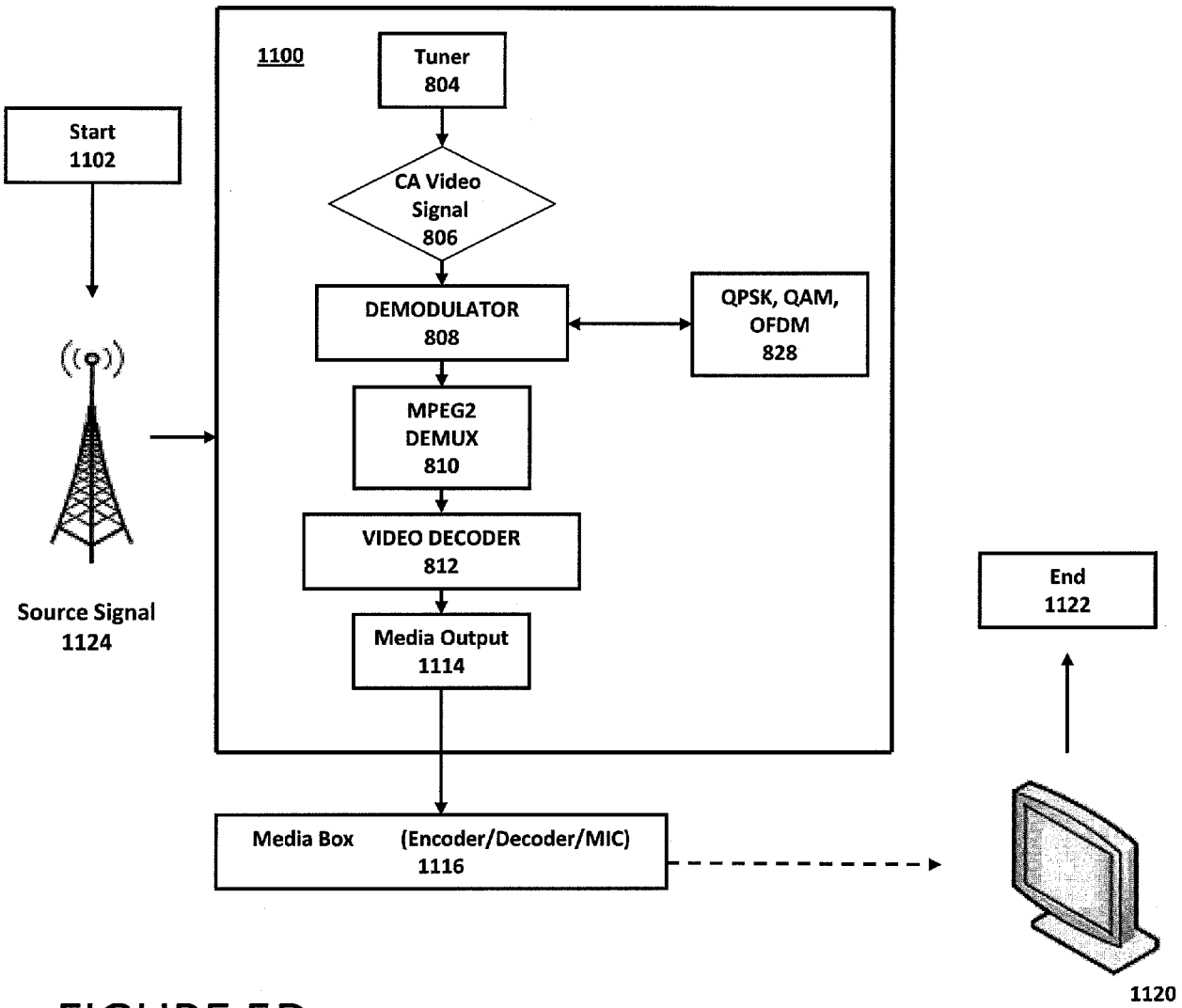
FIG. 5D is an exemplary diagram of a media box connected to the STB and to a media device.

Turning to FIG. 5C, the microphone 1032, analog-to-digital converter 1034, decoder 1036 and storage 1038, discussed in detail above with reference to FIG. 5B, is embodied as a USB stick 1080, which couples to STB 1000. In addition to the advantages discussed above, the embodiment of FIG. 5C provides a convenient and effective way to effect decoding for audience measurement purposes. The embodiment of FIG. 5D is based on the illustration disclosed in FIG. 4, where media box 1116 receives multimedia output from STB 1100 via media output module 1114. Here, media box 1116 contains both the encoding and decoding modules, and a microphone to capture ambient sound, similar to the embodiments in FIGS. 5B-C.

Although various embodiments of the present invention have been described with reference to a particular arrangement of parts, features and the like, these are not intended to exhaust all possible arrangements or features, and indeed many other embodiments, modifications and variations will be ascertainable to those of skill in the art.

The Abstract of the Disclosure is provided to comply with 37 C.F.R. .sctn.1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A method for encoding media in a set-top-box configured to receive media at a set-top box input and process the received media for reproduction, comprising the steps of:

storing a message in the set-top-box;

processing the received media in a frontend of the set-top box to demodulate the received media and produce an audio component; and encoding the audio component in the set-top-box with the stored message comprising one or more symbols, each of said symbols comprising a plurality of substantially single-frequency code components, and wherein the message is masked within the audio component, said encoding being performed prior to the reproduction of the received media via the set-top box.

2. The method of claim 1, wherein the audio component comprises one of pulse code modulated (PCM) digital code or decompressed audio.

3. The method of claim 1, wherein the step of processing the received media comprises the steps of separating the audio component into frequency components.

4. The method of claim 3, further comprising evaluating the frequency components to determine masking ability, and masking the message in the audio component based on the evaluation.

5. The method of claim 1, wherein the media comprises a video component.

6. The method of claim 1, further comprising the step of capturing the encoded audio in the set-top-box.

7. The method of claim 6, wherein the encoded audio is captured via a transducer.

8. The method of claim 6, wherein the captured encoded audio is decoded to determine a characteristic of the media.

9. A system for encoding media, comprising:

a set-top-box comprising an input coupled to a frontend, where the input is configured to receive media and the frontend is configured to demodulate the received media;

a processor, operatively coupled to the input, for processing the demodulated received media for reproduction via the set-top-box and to produce an audio component;

a storage, operatively coupled to the processor, for storing a message in the set-top box; and an encoder, operatively coupled to the processor, for coding the audio component with the stored message comprising one or more symbols, each of said symbols comprising a plurality of substantially single-frequency code components, and wherein the message is masked within the audio component, said encoding being performed in the set-top-box prior to the reproduction of the received media.

10. The system of claim 9, wherein the audio component comprises one of pulse code modulated (PCM) digital code or decompressed audio.

11. The system of claim 9, wherein the processor separates the audio component into frequency components.

12. The system of claim 11, wherein the encoder evaluates the frequency components to determine masking ability, and masking the message in the audio component based on the evaluation.

13. The system of claim 9, wherein the media comprises a video component.

14. The system of claim 9, further comprising a transducer for capturing the encoded audio in the set-top-box.

15. The system of claim 14, further comprising a decoder that decodes the captured encoded audio to determine a characteristic of the media.

16. The system of claim 15, wherein the decoder and transducer are housed within the set-top box.

17. The system of claim 15, wherein the decoder and transducer are housed in a portable device having a data interface for communicating research data generated from the decoded audio.

18. The system of claim 17, wherein the data interface is a universal serial bus (USB) interface.

19. A method for encoding media in a set-top-box configured to receive media at a set-top box input, comprising the steps of:

storing a message in the set-top-box, wherein the message comprises one or more symbols, each of said symbols comprising a plurality of substantially single-frequency code components, and wherein the message comprises information regarding at least one of (i) channel information, (ii) program information, (iii) demographic information and (iv) set-top box system information;

processing the received media in a frontend of the set-top box to demodulate the received media and to produce an audio component; and encoding the audio component with the message prior to reproduction of the received media via the set-top-box, wherein the encoded message is masked within the audio component.

20. The method of claim 19, further comprising the step of decoding the encoded message in the set-top-box.

* * * * *